US005315727A

United States Patent [19]

Lee

[11] Patent Number: 5,315,727

[45] Date of Patent: May 31, 1994

[54] TUB COVER HAVING A CONDENSER OF A WASHING MACHINE

[75] Inventor: Kyu C. Lee, Suweon-city, Rep. of Korea

[73] Assignee: Samsung Electronics Co., Ltd., Suwon-City, Rep. of Korea

[21] Appl. No.: 884,196

[22] Filed: May 18, 1992

[30] Foreign Application Priority Data

Jun. 11, 1991 [KR] Rep. of Korea ..... 91-8573[U]

[51] Int. Cl.[5] ..... D06F 39/00

[52] U.S. Cl. ..... 8/159; 68/18 C

[58] Field of Search ..... 68/15, 18 C, 20; 134/105, 107, 560, 570, 580; 34/73, 75; 8/157, 149.1, 149.2

[56] References Cited

U.S. PATENT DOCUMENTS

| | | | |
|---|---|---|---|
| 1,802,034 | 4/1931 | Perks | 68/18 C |
| 2,243,093 | 5/1941 | Flahive | 68/18 C |
| 2,289,930 | 7/1942 | Payen | 18/18 C |
| 2,390,757 | 12/1945 | Voris | 134/105 X |
| 2,399,555 | 4/1946 | Locke | 68/20 UX |
| 2,777,313 | 1/1957 | Dodge | 68/20 |
| 2,858,688 | 11/1958 | Smith | 68/20 |
| 2,892,335 | 6/1959 | Gray, Jr. | 68/16 |
| 3,111,952 | 11/1963 | Roehl | 134/105 |
| 3,238,750 | 3/1966 | Candor et al. | 68/16 |
| 3,349,579 | 10/1967 | Geschka et al. | 68/16 |
| 3,401,052 | 9/1968 | Ber053165072. | 68/20 |
| 3,762,866 | 10/1973 | Rayment et al. | 68/20 |
| 4,204,339 | 5/1980 | Muller | 68/18 C |
| 4,279,384 | 7/1981 | Yamamoto | 134/58 D |
| 4,483,160 | 11/1984 | Jost | 68/18 C |
| 4,679,721 | 7/1987 | Kondo | 134/105 X |

*Primary Examiner*—Frankie L. Stinson

*Attorney, Agent, or Firm*—Burns, Doane, Swecker & Mathis

[57] ABSTRACT

A tub cover which is mounted on an upper opening of a tub of a washing machine, includes a case shoulder and an inner cover having a condenser with the inner cover hinged with the case shoulder. The condenser comprises a steam inflow opening for enabling the upward passing steam from the tub, a water container member having a plurality of heat-exchanger plates, for heat-exchanging with steam entering therein, and a steam outflow opening for passing outward steam heat-exchanged in the container water member. The heat-exchanger plate comprises a plurality of orifices provided in a plurality of convex portions, and a water container formed between the convex portions.

18 Claims, 4 Drawing Sheets

TUB COVER HAVING A CONDENSER OF A WASHING MACHINE

FIELD OF THE INVENTION

The present invention is related to a tub cover for the tub of a washing machine which has an electrical heater positioned in the tub for heating the wash water, and more particularly to a tub cover having a condenser which condenses the steam from the heating of the wash water, thereby preventing the user from being burned by the steam, increasing a washing efficiency by decreasing the heat loss from the tub and protecting the electrical parts of the washing machine.

BACKGROUND OF INVENTION

A washing machine for boiling clothes is provided with a tub mounted in a vertical axis, in which there is an electrical heater for boiling water installed therein. The washing machine selectively performs a combination of the washing, boiling, rinsing and spinning cycles of operation with boiling water as well as cold and warm water controlled by a predetermined time cycle. Furthermore a tub cover is placed over an opening of an upper portion of the tub to prevent the discharge of steam from the tub. Along the side wall of the tub an overflow pipe is provided for discharging a portion of the steam.

One difficulty that sometimes occurs during use of the washing machine is that an abundant amount of steam is insufficiently discharged from the tub. That is, since the washing machine by structure enables the steam to rise until prevented from rising by the tub cover, at which point the steam is then discharged through an overflow pipe. However, due to the structure of the tub, the steam can not immediately flow out of the tub. Thus, the steam pressure builds up in the tub to a predetermined value, causing the steam to be discharged through an aperture in the tub cover, resulting in damage to the electrical parts of the washing machine. Another common problem is that the user may be burned by the steam when discharged through the aperture of the tub cover. Furthermore, the steam has a high temperature and the loss of the heat of the steam being discharged from the tub decreases the efficiency of the washing machine.

Accordingly, it is an object of the present invention to provide a tub cover for a washing machine having a condenser which prevents damage to the electrical parts of the washing machine as a result of having steam discharge from the tub.

It is a further object of the present invention to provide a tub cover having a condenser which protects the user from being scalded by steam discharged through an aperture in the tub cover.

It is still a further object of the present invention to provide a tub cover having a condenser which increases the efficiency of the washing machine.

SUMMARY OF THE INVENTION

These and other objects of the present invention are achieved in a washing machine comprising a tub cover mounted on an upper portion of the opening of the tub having a condenser therein. The tub cover comprises a case shoulder demountedly fitted into the upper portion of the opening of the tub. The case shoulder provides an access opening for loading clothes into and out of the tub, and an inner cover which hingedly engages with the case shoulder. The inner cover closes or opens the access opening into the interior of the tub. Additionally, the inner cover has a condenser mounted on a lower plate of the inner cover for condensing the steam rising from the tub. The condenser comprises a steam inflow portion which permits steam to pass through a number of the openings therein, a water container member which condenses the steam flowing therein, and a steam outflow portion which permits the outward flow after the steam has been condensed in the water container member. Furthermore, the water container member comprises a plurality of heat-exchanger plates arranged in a stacked formation. The heat-exchanger plates include a plurality of orifices provided in a plurality of convex portions each of which protrude uprightly from the base of the heat-exchanger plate, and a plurality of water containers which is formed in a base of the heat-exchanger plate.

As a result of the above structure, during the boiling cycle of the washing operation, an electrical heater in the tub starts to boil the wash water which generates the steam. The steam rises until the tub cover interrupts the rising movement of the steam. A portion of the steam is discharged through the overflow pipe located along the side wall of the tub. The remaining portion of the steam flows into the condenser positioned on the bottom plate of the tub cover. Once the steam has flowed into the condenser, it rises through the orifices formed between the water containers. During the rising phase the steam follows in a zig-zag direction between a plurality of the heat-exchanger plates, and contacts the surface of the water container removing the heat and changing the steam flow into a relatively cooler and dryer flow upon exiting the condenser.

DESCRIPTION OF THE DRAWINGS

The present invention will now be described in detail with reference to the attached drawings, in which.

DESCRIPTION OF THE PREFERRED EMBODIMENT

Figure 1:
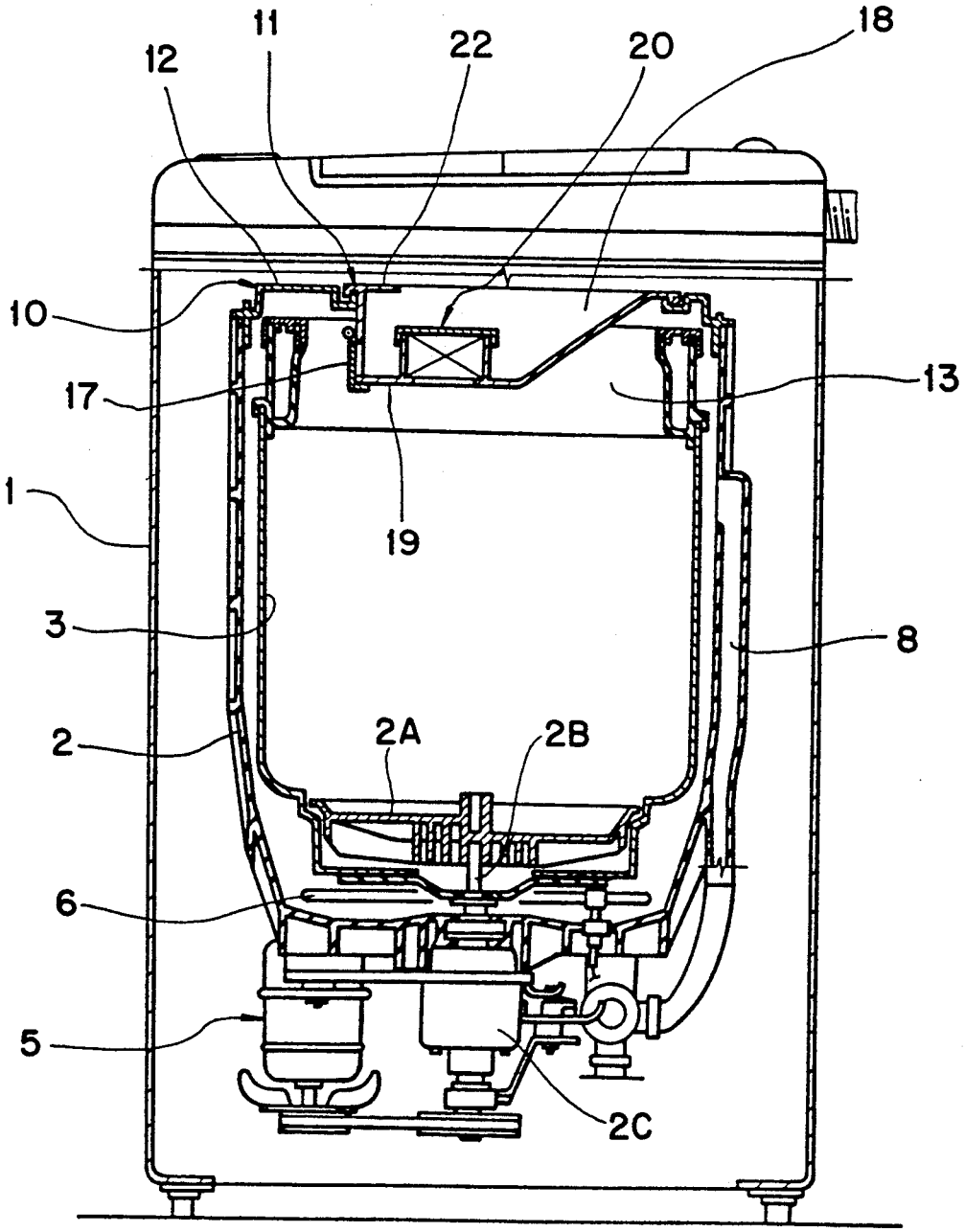
FIG. 1 is a partial sectional view of the washing machine.
Figure 2:
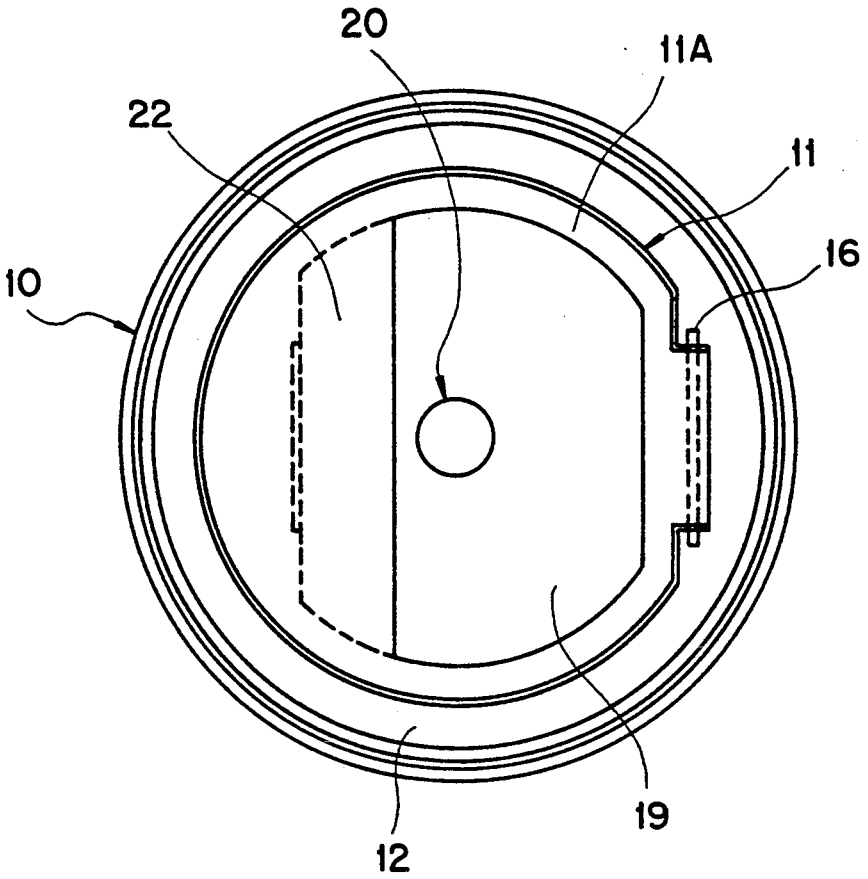
FIG. 2 is a plan view of the tub cover.

FIG. 1 illustrates a washing machine having the tub cover 10 of the present invention. External cabinet 1 contains the tub 2, and a basket 3 positioned in the tub 2 to perform washing and rinsing cycle upon rotational motion by a motor 5. Disposed inside of the tub 2 and basket 3 is an agitator 2A mounted on a vertical shaft 2B which is driven by a motor 2C as is conventional. Adjacent the inner bottom 2B of the tub 2 an electrical heater 6 is positioned. The tub cover 10 is mounted in the upper opening 2A of the tub 2. The tub cover 10, as illustrated in FIGS. 1 and 2, has a circular case shoulder 12 demountedly fitted into the upper opening 2A of the tub 2. In the center portion of the case shoulder 12, an access opening 13 is provided for clothes to be loaded into or removed from the basket 3. The access opening 13 is provided with an inner cover 11, which is mounted to the case shoulder 12 by means of a hinge 16 for providing convenience in closing or opening the access opening of 13, as illustrated in FIGS. 1 and 2. The inner cover 11 comprises a circular plate 11A which engages the case shoulder 12 and a water flow guiding portion 18 in the center of the inner cover 11 terminating at the bottom plate 19. At a front portion 11C of the circular plate 11A, as shown in the left hand side of FIGS. 1 and 2, a grasping portion 22 is positioned opposite the hinge 16. Additionally, in the bottom plate a sluice-gate 17 is formed, enabling water entering through the water flow guiding portion 18 to flow into the tub 2.

Figure 3:
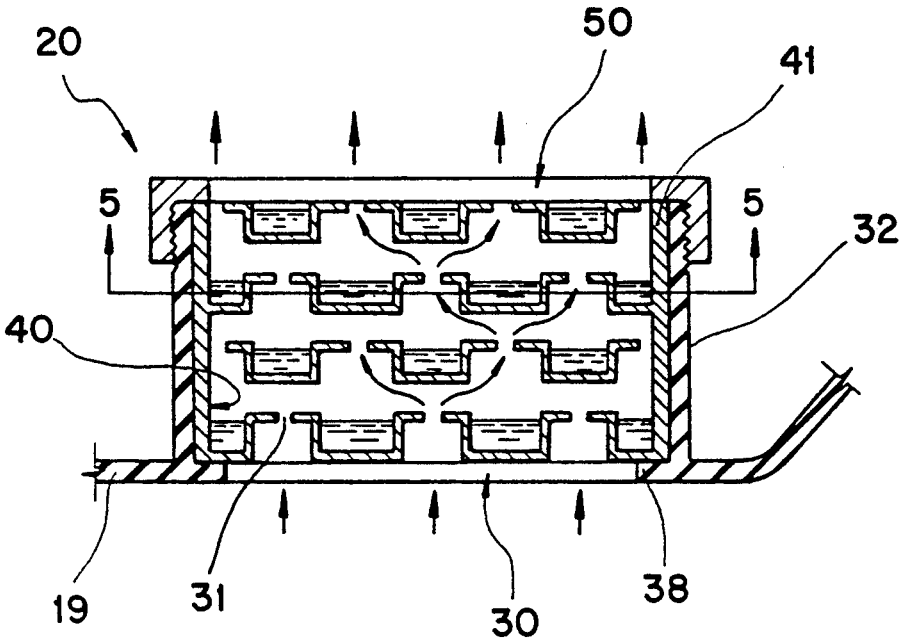
FIG. 3 is a vertical sectional view of a condenser mounted on the tub cover.
Figure 4:
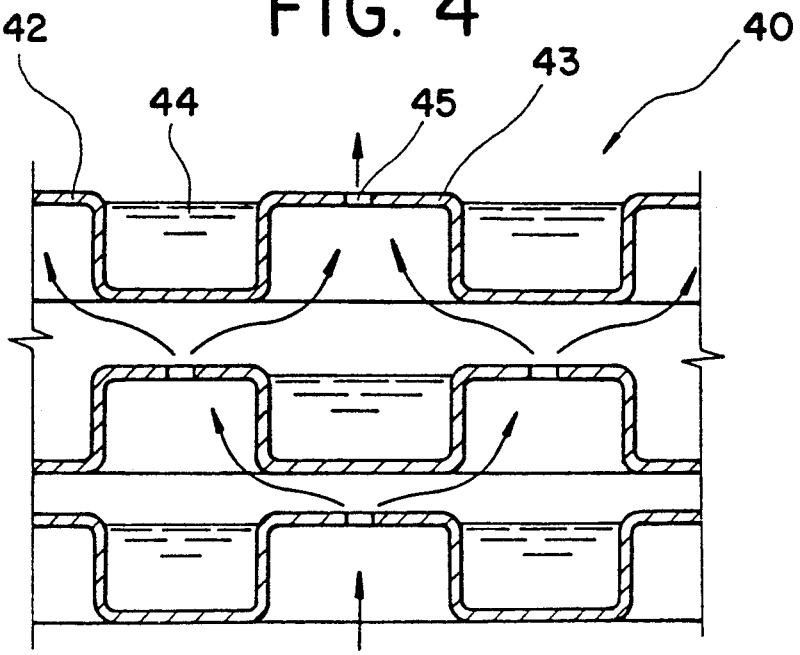
FIG. 4 is a partial vertical sectional view of a heat-exchanger of the condenser.
Figure 5:
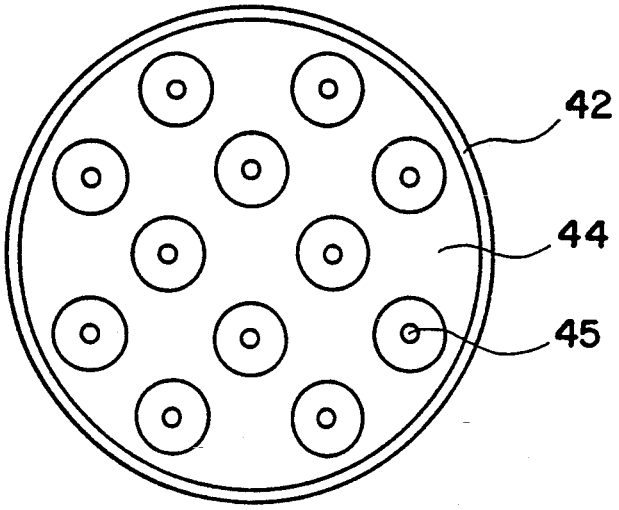
FIG. 5 is a plan view of the condenser along line 5—5 in FIG. 3.

Referring to FIGS. 3, 4 and 5, a condenser 20 is provided on the flat portion of the bottom plate 19. The condenser 20 comprises a steam inflow portion 30 which enables the steam entering the tub 2 to pass through an opening 31 formed in the bottom plate 19, a water container member 40 which condenses the steam entering therein, and a steam outflow portion 50 which enables an outward flow of the steam in a steam or gas form upon exiting the water container member 40. The steam inflow portion 30 comprises a cylinder 32 positioned on the bottom plate 19 and the condenser 20 operatively positioned thereon. The bottom part of the condenser comprises a base 32A of the cylinder 32 and a flange 38 providing a surface upon which the water container member 40 rests. The water container member 40 comprises an external cylinder 41, comprising a plurality of stacked heat exchanger plates 42, which fit slidingly into the cylinder 32. Each heat-exchanger plate 42 comprises a plurality of cylindrical convex portions 43 which protrude upward from the base of the heat-exchanger plate 42, and a water container 44 which is formed in the base of the heat-exchanger plate 42, as is shown in FIG. 5. The center of each convex portion 43 contains an orifice 45 which is formed for passing steam entering or exiting the tub 2. The convex portion 43 of the heat-exchanger plate 42 is arranged in a zig-zag alternating formation between an adjacent upper heat-exchanger plate and an adjacent lower heat-exchanger plate. Thus, the convex portion 43 is placed below the water container 44 of the upper heat-exchanger plate and above the water container 44 of the lower heat-exchanger plate. The outflow portion 50 of the condenser 20 is assembled threadedly with the cylinder 32 of the inflow portion 30.

The inner cover 11 in a closed position encloses the condenser 20 and the water flow guiding portion 18 and the water supply therein. The water falls down into the tub 2 through the sluice-gate 17. Simultaneously, the water feeds into the condenser 20 positioned on the bottom plate 19 of the water flow guiding portion 18. Water fed into the condenser 20 passes the orifice 45 of the convex portion 43 and either remains in the water container 44, or passes into the tub 2 through the opening 31 of the inflow portion 30.

Furthermore, upon supplying electricity to the heater 6, the operation of the machine begins at which time the water in the tub 2 is boiled by the heat from the heater 6, and the clothes in the tub 2 are washed. Consequently, the steam in the tub 2 rises. A portion of the steam is discharged through the overflow pipe 8 formed along the wall of the tub 2, and the remainder of the steam passes into the side condenser 20, positioned on the bottom plate 19 of the water flow guiding portion 18, and is condensed. The condensed water falls down into the tub 2 while the relative cold air is discharged out of the tub cover 10, as is shown in FIGS. 3 and 4.

The steam is interrupted by the lowest heat-exchanger plate 42 of the condenser 20, and passes through the orifice 45 of the convex portion 43. The passed steam encounters the water container 44 of the adjacent upper heat-exchanger plate 42 and mores towards the convex portion 43 of the floor same heat-exchanger plate 42 to pass through the orifice 45 thereof. A portion of the steam rises through the zig-zag steam flow, configuration. During the rising of the steam, the steam heat-exchanges with the relatively cold water in the water container 44 and condenses as a waterdrop on the surface of the water container 44. Finally, the relative cool steam is discharged out of the condenser 20 through the steam outflow portion 50.

Figure 6:
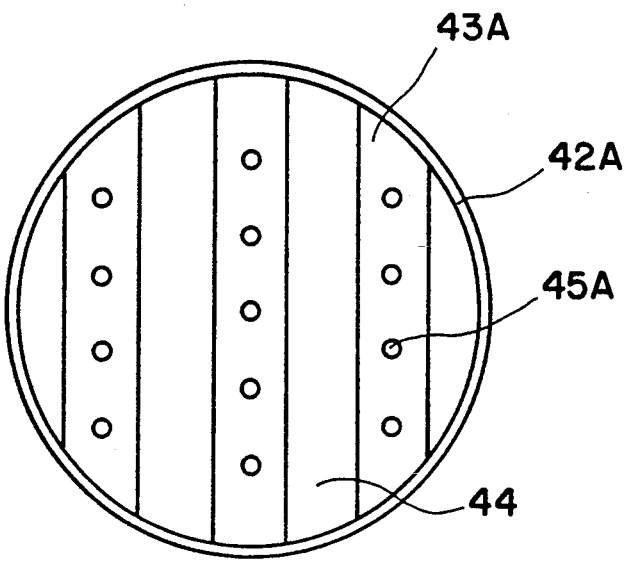
FIG. 6 is a plan view of another embodiment in FIG. 5.

In another embodiment of the heat-exchanger plate, which is shown in FIG. 6, the convex portion 43A is in a lateral configuration along with a plurality of the orifices 45A which are pierced at the convex portion 43A.

According to the above structure, the steam generated from the tub is condensated by the condenser on the tub cover, and the relative cool steam is discharged through the aperture in the top cover. This has the effect of preventing a heat scalding accident as well as protecting the electrical control device is protected from water corrosion. Further, the loss of the heat discharged from the steam from the tub 2 decreases to achieve maximum washing efficiency.

What is claimed is:

1. A method of washing clothes in a machine having a tub with an electrical heater, and a tub cover, comprising the steps of:

boiling wash water in said tub to generate steam which rises until interrupted by said cover, said steam rising until said tub cover interrupts said rising, and discharging a portion of said steam through a condenser rotated on said tub cover, said condenser having a plurality of heat exchanger plates and water-containing members, causing condensation of said steam.

2. The method of claim 1, wherein said steam in said condenser rises through a plurality of orifices formed in convex portions of said heat exchanger plates between a plurality of said water-containing members.

3. The method of claim 2, wherein said steam flows in a zig-zag direction between said heat exchanger plates and water-containing members.

4. The method of claim 2, wherein said steam flows in a lateral direction between said heat exchanger plates and said water-containing members.

5. The method of claim 1, wherein another portion of said steam is discharged through an overflow pipe.

6. A washing machine apparatus, comprising:

a tub for containing wash water, a heater for heating wash water, whereby steam is formed, and a condenser for communicating with said tub for cooling at least some of the steam and discharging the cooled steam from said tub, said condenser comprising a plurality of heat exchanger plates and a plurality of water-containing members, said heat exchanger plates and said water-containing members alternating with one another horizontally and vertically in a zig-zag configuration for condensing said steam.

7. The washing machine apparatus of claim 6, wherein said heat exchanger plates having a convex portion and an orifice therein.

8. The washing machine apparatus of claim 7, wherein said water-containing members are upwardly open in a concave configuration, allowing condensed steam to flow into said water-containing members.

9. The washing machine apparatus of claim 6, wherein said water-containing members are laterally extending troughs, alternating with lateral strips of convex portions having orifices therein.

10. The washing machine apparatus of claim 9, wherein said orifices in said convex portion extend through said lateral strip.

11. The apparatus of claim 6, wherein said tub having an overflow pipe for discharging a portion of said steam.

12. A washing machine apparatus, comprising:

a tub for containing wash water;

a heater for heating wash water, whereby steam is formed;

an overflow pipe for discharging a portion of said steam; and a condenser for communicating with said tub for cooling remaining steam and discharging said remaining steam from said tub, said condenser comprising a plurality of heat exchanger plates and a plurality of water-containing members, said water-containing members are upwardly open, allowing condensed steam to flow into said water-containing members;

wherein said heat exchanger plates, have a convex portion and an orifice therein, and said concave water-containing members alternate with one another horizontally and vertically in a zig-zag configuration for condensing said steam.

13. A washing machine apparatus, comprising:

a tub for containing wash water;

a heater for heating wash water, whereby steam is formed;

an overflow pipe for discharging a portion of said steam;

a condenser for communicating with said tub for cooling remaining steam and discharging said remaining steam from said tub;

said condenser comprising a plurality of heat exchanger plates and a plurality of water-containing members, said water-containing members comprising laterally extending troughs, alternating with lateral strips of convex portions having orifices therein;

wherein said orifices in said convex portion extends through said lateral strip, and said water container members are upwardly open in a concave configuration.

14. A washing machine apparatus, comprising:

a tub for containing wash water, a heater for heating wash water, whereby steam is formed, and a condenser for communicating with said tub for cooling at least some of the steam and discharging the cooled steam from said tub, said condenser comprising a plurality of heat exchanger plates and a plurality of water-containing members, said water-containing members comprising laterally extending troughs, alternating with lateral strips of convex portions having orifices therein.

15. The washing machine apparatus of claim 14, wherein said orifices in said convex portion extend through said lateral strip.

16. A washing machine apparatus, comprising:

a tub for containing wash water, an agitator disposed in a lower portion of said tub, a motor having a vertical rotary output shaft to which said agitator is connected for displacing said agitator, a heater for heating wash water, whereby steam is formed, and a condenser for communicating with said tub for cooling at least some of the steam and discharging the cooled steam from said tub, wherein said tub has an overflow pipe for discharging a portion of said steam.

17. The washing machine apparatus of claim 16, wherein said condenser is located above said agitator and arranged so that steam condensate flows from said condenser back into said tub.

18. The washing machine apparatus of claim 17, wherein said tub includes a top cover, said condenser mounted in said top cover.

* * * * *